United States Patent [19]

Foreman et al.

[11] 4,373,838

[45] Feb. 15, 1983

[54] VACUUM SEWAGE TRANSPORT SYSTEM

[75] Inventors: Brian E. Foreman; John M. Grooms, both of Rochester, Ind.

[73] Assignee: Burton Mechanical Contractors Inc., Rochester, Ind.

[21] Appl. No.: 234,110

[22] Filed: Feb. 13, 1981

[51] Int. Cl.[3] ..... B01D 1/00; B65G 53/00

[52] U.S. Cl. ..... 406/14; 406/192; 137/236 R

[58] Field of Search ..... 406/14, 30, 15, 115, 406/50, 192; 137/205, 236, 396

[56] References Cited

U.S. PATENT DOCUMENTS

| | | | |
|---|---|---|---|
| 4,171,853 | 10/1979 | Cleaver et al. | 496/192 X |
| 4,179,371 | 12/1979 | Foreman et al. | 137/236 R |
| 4,245,664 | 1/1981 | Johnson | 137/236 R |

*Primary Examiner*—John J. Love
*Assistant Examiner*—L. E. Williams
*Attorney, Agent, or Firm*—McDougall, Hersh & Scott

[57] ABSTRACT

A vacuum transport system for intermittently transporting sewage from a source to a collection station through a vacuum conduit under the differential influence of positive atmospheric pressure at the source and substantially lower or vacuum pressure in the vacuum conduit between a primary control valve and the collection station. The control valve of the system is operated by differential pressure to open and close the vacuum conduit at intervals for sewage transport to the collecting station when a pressure differential operated sensor-controller apparatus, which will automatically purge condensate accumulation, selectively controls the operation of the primary control valve. One part of the sensor element of the apparatus is connected in pressure communication with the sewage source, but is closed to fluid flow when in stand-by condition, and another part is connected in pressure communication with sequentially activated differential pressure responsive controller elements oriented between the sensor and the control valve. The controller elements are connectible alternately to the vacuum in the conduit and an atmospheric source, and when the sensor detects pressure variations at the sewage source, it will respond to a pre-selected sensed pressure condition at the source to sequentially activate the differential pressure responsive elements of the controller to open the control valve while detection of a second pressure condition results in closing the control valve by sequentially reversing activation of the differential pressure responsive controller elements to automatically return the sensor-controller apparatus to its stand-by mode during which air passage through the apparatus is prevented.

14 Claims, 3 Drawing Figures

VACUUM SEWAGE TRANSPORT SYSTEM

BACKGROUND OF THE INVENTION

The present invention relates generally to sewage systems which utilize differential pressures to produce sewage transport through the system as contrasted with the more conventional gravity-operated and positive pressure sewage systems. More particularly, the invention relates to vacuum sewage transport systems and apparatus for controlling the operation of such systems.

As distinguished from conventional simple gravity flow sewage systems, vacuum sewage transport systems necessarily rely upon applied energy. In addition, vacuum systems often require a higher degree of mechanization and operational control than simple gravity flow systems. Nevertheless, gravity and positive pressure systems are not cost effective for many applications, and particularly those involving flat terrain, high water table, unstable soil, and rocky terrain.

In the development of vacuum sewage technology emphasis has been placed upon the need to upgrade the systems to enhance reliability, and to reduce installation, maintenance and service costs. Recently, an even greater emphasis has been directed to a reduction in system energy consumption. An example of progress in these directions is found in applicant's U.S. Pat. No. 4,179,371.

As an early alternative to existing conventional gravity-operated and positive pressure sewage systems, various types of vacuum sewage systems have been proposed. U.S. Pat. No. 3,115,148 issued to S. A. J. Liljendhal describes a vacuum system for separately conveying waste products discharged from water closet bowls, urinals, and like sanitary apparatus, while the waste products, or gray water, from bathtubs, wash basins, sinks, and the like are conveyed by a separate conventional gravity system. Similarly, the U.S. Pat. Nos. 3,730,884 to B. C. Burns, and 4,171,853 to D. D. Cleaver et al., are illustrative of other, more recent, vacuum system developments in the art.

The development of control apparatus technology usable in vacuum sewage transport applications is exemplified in the prior art by patents, such as U.S. Pat. No. 3,662,779 to U. A. Weber et al., which details a pressure control apparatus utilizing a bleed pressure control for a diaphragm, U.S. Pat. No. 3,774,637 to U. A. Weber et al., which describes a diaphragm operated three-way spool valve; U.S. Pat. No. 3,791,397 to G. J. Janu which describes a diaphragm operated pressure sensor; and U.S. Pat. No. 3,777,778 to G. J. Janu which illustrates and describes a two-position liquid level flow controller.

As these prior art patents demonstrate, the trend in the developing technology of vacuum sewage systems, and particularly their control elements, has been toward ever increasing mechanical complexity.

Since the typical installed vacuum sewage system is almost entirely below ground, the control elements of such systems are continuously subjected to the effects of the hostile environment in which they must operate. In particular, this hostile environment will invariably produce relatively low ambient operating temperatures and high atmospheric moisture content. Obviously, these conditions can be expected to produce significant accumulations of water in system control elements as a result of condensation of moist air on cool operating surfaces. Such water accumulations have created troublesome problems in the maintenance of long term reliable operation of vacuum sewage systems. And, at times, the reliability of both the systems, as a whole, and the control apparatus components of the systems have been adversely effected by condensation and its associated problems.

The increasing complexity of the control apparatus developed fo the systems has tended to increase system costs and installation costs, as well as maintenance and service costs. And the developing complexity of the control apparatus components has still further aggravated the effects of the hostile operating environment of the systems.

SUMMARY OF THE INVENTION

The invention is directed to the transport of a sewage means from a source to a collection station. A pressure differential is maintained in the system between the sewage source and the collection station. Sewage, usually at atmospheric pressure, is introduced for transport into a conduit which is maintained at relatively lower or vacuum pressure as is the collecting station. The differential pressure produces rapid sewage transport through the system. When no sewage is in transport in the system, the conduit and collecting station remain at a substantially constant low or vacuum pressure throughout.

When a predetermined pressure is reached at the source of sewage or holding tank therefore, a sensor element of a sensor-controller module, which is connected in pressure communication with the source, is activated. At the selected pressure, the sensor will activate differential pressure responsive elements of the controller portion of the module. These elements will provide automatic control of the open and closed condition of a control valve in the vacuum line which, when opened, will permit introduction of sewage from the source into the low pressure or vacuum conduit for rapid differential pressure transport to the collecting station.

After the control valve is opened and sewage introduced into the conduit, the activation of the differential pressure responsive elements is automatically reversed to close the control valve and condition the sensor-controller module for subsequent sewage transport following reopening of the control valve.

The vacuum sewage system of the invention provides automatic intermittent sewage transport with a mechanically simplified and integrated sensor-controller module which can be produced at a cost significantly lower than sensor and controller devices presently used in these systems. Associated with the manufacturing cost reduction are reductions in maintenance and service requirements for sewage systems coupled with an increase in system reliability.

In particular, the sensor-controller module of the invention has been designed to produce significant energy economies by shutting off air flow through the module when it is in its normal stand-by condition. The parts and orifices of the module, coupled with a dip tube, have been arranged for continuous self-draining and intermittent discharge of condensate from the module. Restricted orificing is provided at selected points in the module to enhance the positive opening and closure of its differential pressure responsive elements during control valve actuation.

The number of mechanical parts in the integrated sensor-controller subject to failure and servicing has been greatly reduced. The compact nature of the module has reduced installation and maintenance space requirements. These features have improved the reliability of the vacuum sewage system with a resultant reduction of service and maintenance.

DETAILED DESCRIPTION OF THE PREFERRED EMBODIMENT

Figure 1:
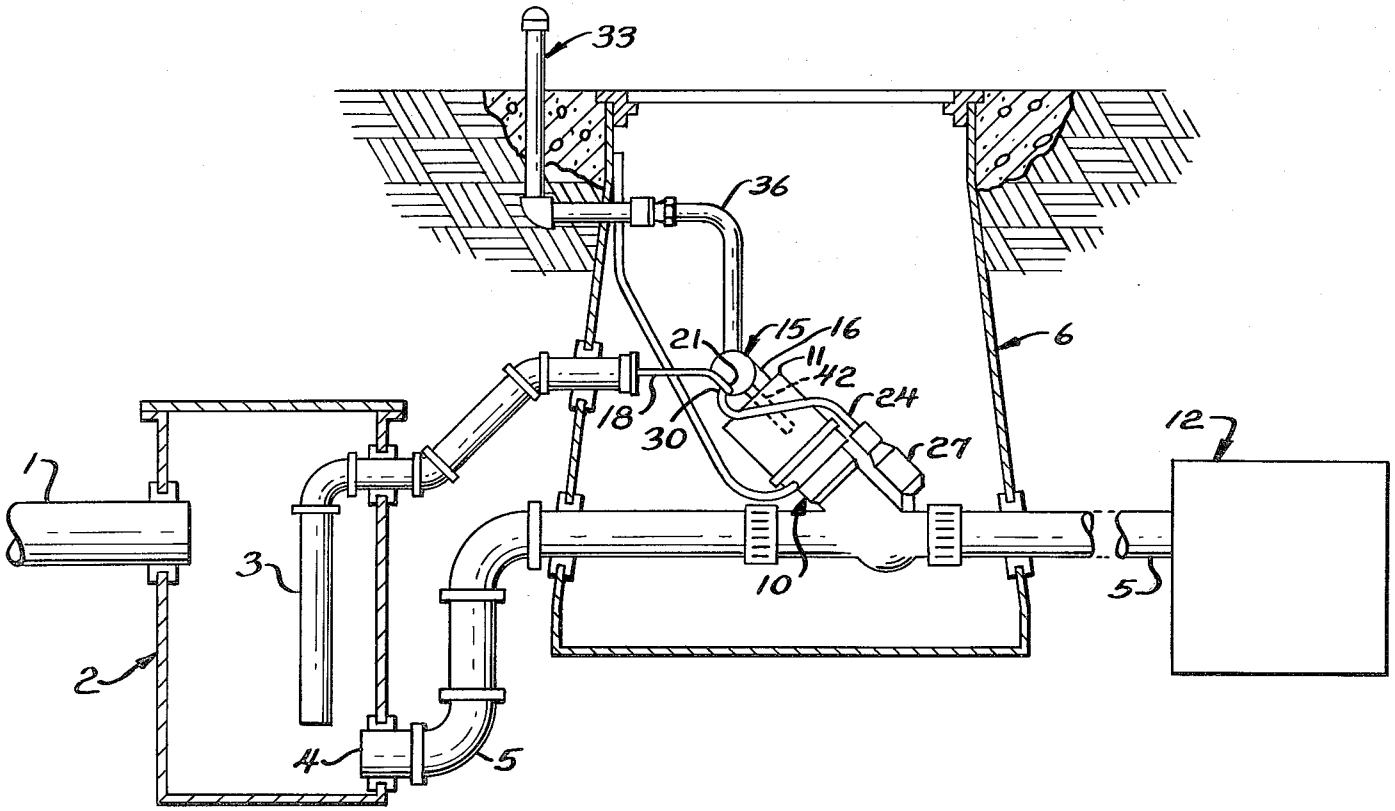
FIG. 1 is a diagramatic representation of the vacuum sewage transport system of the invention.

The system, as illustrated in FIG. 1, includes a gravity sewer conduit 1 at atmospheric pressure which drains from a sewage origination point in a dwelling. The gravity sewer conduit 1 is arranged to carry sewage to a holding tank 2. Like the gravity sewer conduit 1, the holding tank is ordinarily maintained at essentially atmospheric pressure. A sensor pipe 3 is supported near the top of the holding tank 2 and extends downwardly to a point spaced above the inlet opening 4 of the holding tank discharge conduit 5. The sensor pipe 3 extends from its top support generally laterally to a valve pit, generally designated 6, into which the sensor pipe 3 opens.

The holding tank discharge conduit 5 extends from the holding tank 2 and into the valve pit 6. Interposed in the discharge conduit 5 within the valve pit 6 is a system control valve, generally designated 10. The details of construction and operation of a control valve 10 of the invention are set forth in U.S. Pat. No. 4,171,853 to Cleaver et al. In the operation of the vacuum sewage system of the invention, the normal condition of the valve 10 is closed. Downstream from the control valve 10 in the discharge conduit 5, the line is maintained at low or vacuum pressure. The vacuum portion of the discharge conduit 5 between the control valve 10 and a collection station of the type illustrated and described in applicant's U.S. Pat. No. 4,179,371 is maintained under low pressure or vacuum conditions with the collection station 12, illustrated schematically in FIG. 1, by a source of applied vacuum.

During the operation of the system, sewage is discharged from a residential source into the gravity sewer conduit 1 which in turn discharges the sewage into holding tank 2. Under preselected pressure conditions in the holding tank, i.e. when the sewage content of the holding tank is such that a discharge cycle is warranted, the control valve 10 is opened by the sensor-control apparatus to be more fully described below. Opening of the control valve 10 creates a differential pressure between the relatively low pressure or vacuum portion of discharge conduit 5 downstream from the valve and the relatively higher or atmospheric pressure portion of conduit 5 upstream from the valve 10. This pressure differential will result in the very rapid discharge of the sewage content of holding tank 2 through the inlet opening 4 of discharge conduit 5 past control valve 10 and into and through the vacuum portion of discharge conduit 5 and ultimately to the collection station 12 for subsequent processing or disposal. Upon completion of the discharge of sewage from tank 2 through the discharge conduit 5, the control valve 10 is automatically closed and the vacuum sewage transport system of the invention is restored to its normal stand-by condition.

Figure 2:
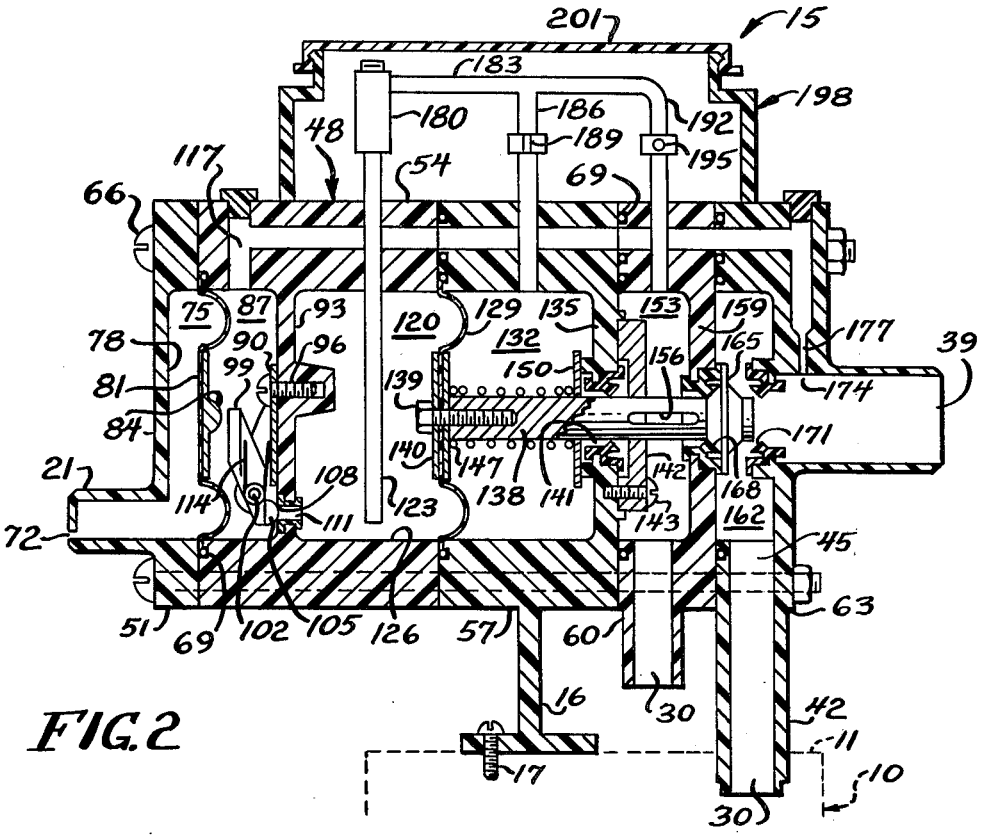
FIG. 2 is a view in cross-section of the sensor-controller module of the invention illustrating a stand-by condition.
Figure 3:
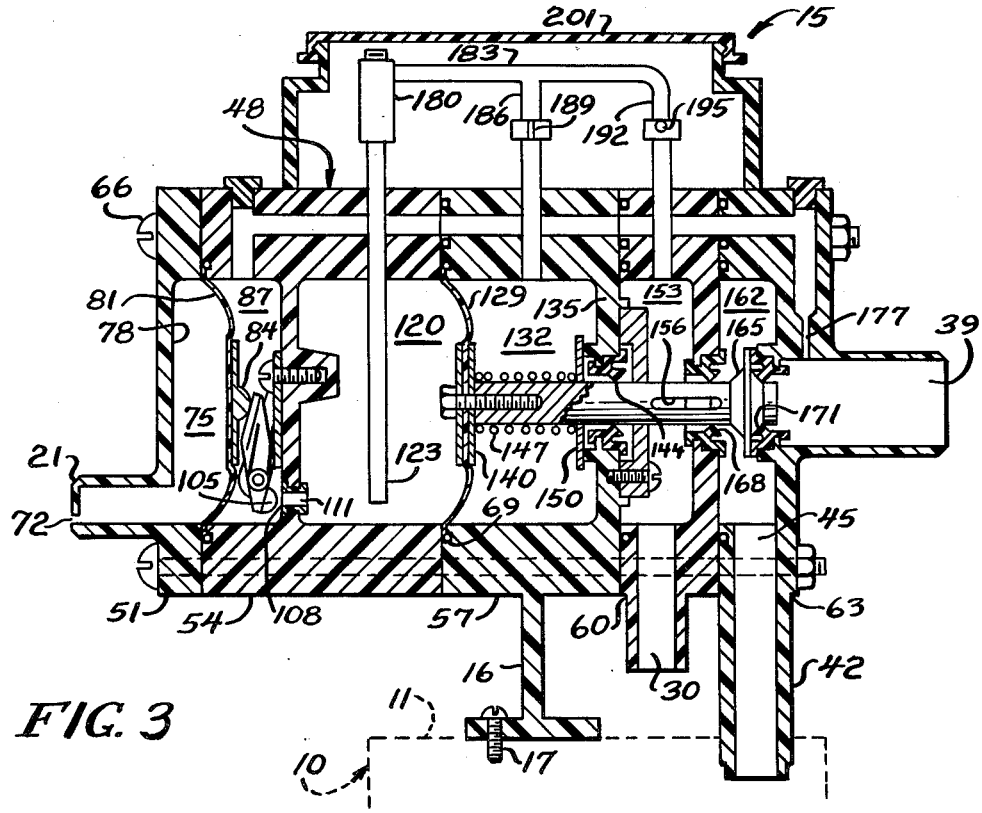
FIG. 3 is a view in cross-section of the sensor-controller module of the invention in a control valve activated condition.

Referring to FIG. 1, the control valve 10 is provided with an integrated sensor-controller module, generally designated 15, and which is shown in greater detail in the cross-sectional views of FIGS. 2 and 3. The sensor-controller module 15 is mounted upon the upper end 11 of valve 10 by a bracket 16 and is secured thereto by screws 17, but viewed in FIGS. 2 and 3 although the orientation of the sensor-controller module 15 with respect to the upper end of valve 10 is best seen in FIG. 1.

A pressure sensor conduit 18 is disposed in pressure communication with the sensor pipe 3 at one of its ends and, at its opposite end, is coupled to pressure sensor port 21 positioned at the lowest point of the sensor-controller module 15. Vacuum is supplied to the sensor-controller through a vacuum line 24 connected through a surge tank 27 more fully described in relation to item 34 in U.S. Pat. No. 4,171,853. The surge tank communicates with the vacuum portion of discharge conduit 5 and thereby supplies a constant low pressure or vacuum source to the sensor-controller through vacuum line 24 and vacuum port 30. Atmosphere is directed to the sensor-controller 15 from above the surface of the installation through an air breather generally designated 33 which communicates with an atmospheric pressure conduit 36 which supplies atmospheric pressure to the sensor-controller through atmosphere port 39 as seen in FIGS. 2 and 3. The sensor-controller communicates with the pressure differentially operated valve 10 through a valve connector 42 disposed in pressure communication with the upper end 11 of valve 10 and valve connector port 45 of module 15, as is best observed in FIGS. 2 and 3. The details of the structural and functional interaction of the valve connector 42 and the pressure differentially operated control valve 10 are amplified in U.S. Pat. No. 4,171,853.

The sensor-controller module 15 is preferably fabricated from an impact resistant A.B.S. (acrylonitrile, butadine and styrene) resin. The module includes a generally cylindrical housing 48 formed from an assembly of generally cylindrical and axially aligned molded elements 51, 54, 57, 60 and 63. The assembly of elements is axially secured by a series of radially aligned through-bolts 66 and fluid tight integrity is maintained by annular seals 69 between the molded elements.

Sensor port 21 is provided with an orifice 72, preferably 0.020 inches in diameter. Orifice 72 opens into a first sensor chamber 75 which is defined by wall 78 of cylindrical element 51 and a flexible diaphragm 81 formed from a nitrile or other suitable elastomeric material. The diaphragm is fitted with a pressure plate 84 which extends generally axially into a second sensor chamber 87. Diaphragm 81 effectively seals chamber 75 and 87 against fluid flow or exchange after the module has been assembled.

A base plate 90 is secured to wall 93 of element 54 by 2 screws 96. A valve lever 99 is pivotally mounted at 102 to base plate 90 and carries a molded nylon valve bulb 105 which closes on a soft nitrile elastomeric valve seat 108 bordering a port 111 oriented in the lowest portion of housing 48. Port 111 is generally axially aligned with orifice 72 and sensor port 21. A torsion spring 114 on pivotal mount 102 is interposed between valve lever 99 and base plate 90 and normally biases lever 99 and plate 90 apart to maintain valve bulb 105 in the normally seated stand-by condition illustrated in FIG. 2. Chamber 87 is normally vented to atmosphere through atmospheric conduit 117 and valve bulb 105 and seat 108, when closed as shown in FIG. 2, maintain atmospheric pressure in chamber 87 during stand-by and preclude air or fluid flow through the sensor chambers in the stand-by condition.

When open, port 111 provides fluid communication between the second sensor chamber 87 and a first controller chamber 120. A dip tube 123 projects through the top of annular wall 126 of housing 48 and downwardly in chamber 120 to a point just above the lowermost portion of the annular wall 126 adjacent which the dip tube opens.

Chamber 120, opposite housing wall 93, is enclosed by a flexible nitrile elastomer diaphragm 129 which forms a second controller chamber 132 with wall 135 of housing element 57. A generally cylindrical rod 138 is secured to diaphragm 129 by a screw 139 threaded through the diaphragm and pressure transfer plates 140 and into one end of the rod 138. As shown in FIGS. 2 and 3, rod 138 extends laterally from diaphragm 129 in generally axial alignment with the axis of housing 48 and through an opening 141 provided therefore in wall 135 and rod bearing 142 which is secured to wall 135 by three screws 143. As shown, a fluid seal 144 is provided to prevent fluid or pressure leakage from chamber 132 through the opening 141 bordering rod 138. A compression spring 147 is telescoped over rod 138 and is biased between thrust plate 150 and diaphragm pressure plate 140 to maintain the diaphragm 129 in the normal stand-by position illustrated in FIG. 2.

Opposite second controller chamber 132, wall 135 defines an end of another controller chamber 153 which opens through port 30 to the vacuum line 24 which communicates with the vacuum side of the discharge conduit 5. As is shown in FIG. 2, rod 138 is provided with a radially extending slot 156 which extends completely through the rod. In the stand-by position illustrated in FIG. 2, all of radial slot 156 is contained within chamber 153 to preclude leakage of vacuum or low pressure therefrom.

Wall 159 of housing element 60 defines the opposite end of chamber 153 and a wall of chamber 162. This latter chamber receives the distal end of rod 138 which carries a double acting valve head 165. Chamber 162 is provided with a pair of opposed double seal valve seats 168 and 171 which are co-axially aligned with rod 138 and its double acting valve head 165. When the sensor-controller is in the stand-by condition of FIG. 2, valve head 165 engages left-hand seat 168 to prevent vacuum communication from chamber 153 with chamber 162 and valve connection port 45. Seat 171 is axially aligned with atmospheric air port 39 and remains open in the FIG. 2 stand-by condition subjecting chamber 162 and valve connector port 45 to the continuous influence of atmospheric air pressure from port 39 during stand-by.

Atmospheric air conduit 117 opens directly into port 39 at 174. To control the speed of air movement through conduit 117 an orifice 177 is placed in conduit 117 adjacent opening 174. In the preferred embodiment this orifice is about 0.063 inches in diameter. Further control of air flow to, through and from chambers 87, 120, 132 and 153 and the speed of pressure communication and equalization therein is achieved through dip tube 123 which is connected to a screw-adjustable and infinitely variable needle-valve 180. Adjustment of the needle-valve 180 will vary the speed of fluid flow into and out of the dip tube 123 and chamber 120. Fluid communication between chamber 120 and chambers 132 and 153 is achieved through the dip tube 123 and connecting tube 183. Branch 186 of tube 183 communicates with chamber 132 through a 0.016 inch diameter orifice 189 and controls the speed of fluid exchange between chamber 132 and tube 183. Branch 192 of tube 183 communicates with chamber 153 through a check valve 195 which is maintained in open condition during sensor-controller stand-by as in FIG. 2. This serves, through vacuum port 30, branches 186, 192 of tube 183, dip tube 123 and needle-valve 180, to maintain equalized pressure in chambers 120, 132 and 153 at the low or vacuum pressure of the discharge conduit 5 of the transport system during stand-by.

The needle valve 180, tube 183, branches 186 and 192, orifice 189 and check valve 195 assembly are enclosed by a housing 198 secured to the cylindrical housing 48 of module 15. Housing 198 can be opened by a snapped on lid 201 for easy access to the enclosed components of the assembly.

In normal operation, the sensor-controller module 15 will remain in the stand-by condition illustrated in FIG. 2 when a 4 inch water gauge pressure or less exists at pressure sensor port 21. As illustrated, sensor valve bulb 105 and associated valve seat 108 are sealed by the force of spring 114 coupled with the differential atmospheric pressure maintained in chamber 87 and the low or vacuum pressure maintained in chamber 120. As a result, no air flow occurs between the sensor and controller components of the sensor-controller module. In addition, no fluid exchange or flow occurs at any time during the operation of the module between the first and second sensor chambers 75 and 87. Therefore, by limiting air flow or fluid flow through the second sensor chamber 87, only to the operational mode of the sensor-controller, significant system energy savings can be realized by cutting off air or fluid flow through the module during the substantial stand-by intervals of the system even though atmospheric port 39 remains open during the stand-by condition of the module.

When the sewage accumulation in holding tank 2 produces a pressure of approximately 4 and ½ inches of water gauge which is communicated to the sensor pressure port 21 through sensor pipe 3, the gap between the pressure plate 84 carried by the sensor diaphragm 81 is urged by the increased pressure in the first sensor chamber 75 into engagement with the lever 99. The pressure plate forces lever 99 against the bias of torsion spring 114 about pivotal mount 102 and lifts the valve bulb 105 from the associated valve seat 108, as illustrated in FIG. 3. This establishes fluid and atmospheric pressure communication between the second sensor chamber 87 and the first controller chamber 120 as atmospheric air in chamber 87 and from atmospheric conduit 117 through orifice 177 and opening 174 of port 39 enters directly into controller chamber 120 through port 111 which borders valve seat 108.

Orifice 177 in atmospheric conduit 117 is designed to produce an essentially instantaneous vacuum condition under diaphragm 87 at the moment valve bulb 105 is lifted in response to increased pressure in holding tank 2. This ensures the positive lifting of valve bulb 105 to provide atmospheric pressure in chamber 120. In addition, when the pressure differential operated controller elements are being sequentially activated and completing a cycle, a vacuum will not be created in chamber 87 such as could produce repeated cycling of the system rather than sequential positive opening and closing of elements.

As the low or vacuum pressure in chamber 120 is increased by the introduction of air at atmospheric pressure into chamber 120, the spring biased diaphragm 129 and the low or vacuum pressure of chamber 132 move the diaphragm 129 and the cylindrical rod 138 to the right hand position illustrated in FIG. 3.

As the rod 138 moves in the right-hand direction, the double acting valve head 165 is displaced from the double seal valve seat 168 and becomes seated on corresponding valve seat 171 which acts to close atmospheric air port 39 against further communication of atmospheric air into chamber 162 and valve connector and port 42 and 45 respectively. As is illustrated in FIG. 3, lateral slot 156 formed in rod 138 establishes fluid and pressure communication between chamber 153 and chamber 162 thereby exposing the latter to low or vacuum pressure from port 30 and vacuum line 24. As the atmospheric pressure communicating with control valve 10 through valve connector 42 and port 45 is decreased under the influence of flow or vacuum pressure from control chamber 153, the control valve 10 is activated, as more fully described in U.S. Pat. No. 4,179,371. The low or vacuum pressure acts to activate valve 10 which opens discharge conduit 5 to introduction of the sewage content of holding tank 2 through opening 4. Since the holding tank is essentially at atmospheric pressure, the low or vacuum pressure on the downstream side of discharge conduit 5 measured from the control valve 10 results in a differential pressure which causes the sewage to be discharged into conduit 5 relatively rapidly and transported to collection station 12.

The discharge of sewage from the holding tank 2 will produce an almost immediate drop of water gauge pressure in communication with the sensor diaphragm 81 through sensor pipe 3. This then commences a reversal of the activation of the differential pressure responsive control elements of the sensor-controller module of the invention.

The pressure drop at diaphragm 81 acts to back pressure plate 84 off of lever 99 resulting in the prompt spring biased closure of valve bulb 105 on seat 108 thereby sealing off port 111 against further transmission of atmospheric air pressure into first controller chamber 120. The line vacuum in chambers 153 and 162 begins to drop. This results in closure of check valve 195 as the pressure in control chambers 120 and 132 begins to equalize through dip tube 123, needle-valve 180, tube 183, branch 186 and orifice 189. The rate of equalization can be selectively controlled by adjustment of the needle-valve 180 and by the selection of the size of orifice 189. As the differential pressures in chambers 120 and 132 equalize, the diaphragm 129 and rod 138 moves to the left in response to the influence of compression spring 147. With this leftward movement of rod 38, atmospheric air port 39 is reopened to flow into chamber 162 as the doubleacting valve 165 is raised from the double seal valve seat 171. Atmospheric air pressure again communicates through valve connector 42 and port 45. The pressure change results in closure of valve 10. With the equalization of pressure in chambers 120 and 132, the double acting valve head 165 closes on seat 168 thereby closing chamber 153 against further transmission of low or vacuum pressure to chamber 162. When this occurs, check valve 195 resumes its normally open condition and pressure across chambers 120, 132 and 153 is equalized to that of the vacuum line pressure of discharge conduit 5.

Because of the typical operation of sewage transport systems under relatively low temperatures and high humidity, condensation in those elements exposed to the low temperature and air exchange is a relatively frequent occurrence. For this reason, sensor port 21 and associated orifice 72 are placed at the lowest point in the sensor-controller module when the unit is installed on a valve 10 as illustrated in FIG. 1. With this installation, condensate developing in sensor chamber 75 will flow freely from the chamber into the sensor pipe 3 and any accumulation in the pipe will be discharged during discharge of the holding tank 2. The orifice 72 in port 21 not only acts as a condensate drain, it also prevents air flow into holding tank 2 during a discharge cycle from inadvertantly triggering the sensor elements when the controller valve 10 suddenly and positively moves to a closed position.

Chamber 87, which is exposed to atmospheric air flow through port 39, opening 174, orifice 177, and conduit 117, can also be subject to condensation build-up. For this reason, port 111 has been oriented at the lowest level of the sensor-controller module in its installed configuration and will permit flow from chamber 87 into chamber 120 during a control valve activation cycle. Condensation accumulated in chamber 120 and condensate transported thereto through port 111 will be intermittently discharged from chamber 120 through dip tube 123, past needle-valve 180 and through tube 183, past check valve 195 in branch 192, through vacuum chamber 153 and finally out of port 30 into discharge conduit 5. This occurs automatically as a pressure imbalance between chambers 120 and 153 is created by the opening of port 111. The high or atmospheric pressure developed in chamber 120 through the opening of port 111 forces any condensate accumulated in chamber 120 through the dip tube, bypassing orifice 189 and branch 186, with its ultimate discharge into low or vacuum pressure chamber 153. The orifice 189 in branch 186, however, not only acts as a restriction to preclude undesired introduction of condensate into chamber 132, as a rate of pressure exchange or equalization element, it also obviates cycling of the controller elements when the unit is first connected to a vacuum source.

In operation of the system of the invention, while port 21 will continuously discharge condensate from chamber 75, any accumulation in chambers 87 and 120 will be automatically discharged or purged intermittently as control valve 10 is opened by the sensor-controller module 15.

We claim:

1. A vacuum sewage transport system comprising a sewage holding means, a sewage transport conduit connected to the holding means at one end and a sewage collecting means at another end for collection of sewage from the holding means, valve means in the transport conduit disposed between the holding means and the collecting means to selectively control sewage transport from the holding means to the collecting means, means for maintaining low pressure or vacuum conditions in the conduit between the valve means and the collecting means, the valve means being operated by differential pressure applied thereto to open and close the sewage transport conduit and selectively permit sewage transport from the holding means to the collecting means, a pressure differential operated apparatus for automatically controlling the operation of the valve means in the transport conduit to selectively control the alternate opening and closing of the valve means and transport conduit and to thereby control the flow therethrough of sewage from the holding means to the collecting means, the apparatus having a pressure sensor means connected at one end in pressure communication with the sewage holding means but closed to fluid communication through the sensor means to the holding means, the pressure sensor means connected at another end in pressure communication with the valve means through sequentially activated differential pressure responsive control elements disposed between the pressure sensor means and the valve means and including means for alternately connecting the elements to the low or vacuum pressure in the transport conduit and a source of relatively higher pressure, the sensor means acting to sense pressure variations in the sewage holding means and in response to a predetermined sensed pressure condition in the holding means to sequentially activate the differential pressure responsive control elements to operate the valve means to open the sewage transport conduit and permit sewage transport from the holding means to the collecting means, and means for closing the valve means by sequentially reversing activation of the differential pressure responsive control elements in response to another pressure condition in the holding means, and automatically conditioning the pressure sensor means without fluid communication through the sensor means to the holding means for subsequent pressure responsive sewage transport.

2. The system of claim 1 wherein the pressure differential operated apparatus includes automatic condensate removal means.

3. The system of claim 2 wherein the automatic condensate removal means include continuously operable condensate removal elements and intermittently operable condensate removal elements.

4. The system of claim 1 wherein means are provided to control the sequential activation interval of the differential pressure responsive control elements.

5. The system of claim 4 wherein variable means are provided for controlling the sequential activation interval of at least some of the differential pressure responsive control elements.

6. The system of claim 1 wherein the means for alternately connecting the control elements to low or vacuum pressure and a source of relatively higher pressure include pressure communication control means to produce positive operation of the sensor and differential pressure responsive control elements while preventing undesired cycling of the automatic control apparatus of the system.

7. A pressure differential operated controller apparatus for selectively controlling the operation of a first valve means interposed in a fluid flow conduit of a vacuum sewage transport system to control the alternate opening and closing of the first valve means and conduit and thereby the transport therethrough of sewage comprising, a pressure sensor means closed to flow of fluid therethrough and operatively connected in pressure communication with a sewage mass upstream from the first valve means, the sensor means acting to sense pressure variations upstream from the valve means and operatively coupled to the valve means, the pressure sensor means including second valve means which open and close in response to predetermined sewage pressures upstream from the first valve means, the second valve means opening in response to a first sensed sewage pressure condition and thereby sequentially activating differential pressure responsive control elements disposed between the sensor means and the first valve means to operate the first valve means to open the conduit and permit the downstream transport of sewage in the conduit, and means for closing the first valve means by sequentially reversing activation of the differential pressure responsive control elements and closing the second valve means in response to a second pressure condition upstream from the first valve means, closure of the second valve means automatically conditioning the pressure sensor means without flow of fluid therethrough for a subsequent pressure responsive opening and closing cycle of the first valve means and the second valve means.

8. The controller apparatus of claim 7 including automatic condensate removal means.

9. The controller apparatus of claim 8 wherein the automatic condensate removal means include continuously operable condensate removal elements and intermittently operable condensate removal elements.

10. The controller apparatus of claim 7 wherein means are provided to control the sequential activation interval of the differential pressure responsive control elements.

11. The controller apparatus of claim 10 wherein variable means are provided to control the sequential activation interval of the differential pressure responsive control elements.

12. The controller apparatus of claim 7 wherein means are provided for alternately connecting the control elements to a source of low pressure and a source of relatively higher pressure and include pressure communication control means for producing positive operation of the sensor and differential pressure responsive control elements while preventing undesired cycling of the apparatus.

13. In a vacuum sewage transport system, an apparatus for selectively controlling the operation of flow control means for a first fluid in a fluid flow conduit to alternately open and close the conduit to flow of the first fluid comprising, a pressure sensor means closed to flow of a second fluid therethrough for sensing pressure variations in the fluid conduit upstream from the flow control means and operatively coupled to the flow control means, the pressure sensor means including first valve means which open and close in response to predetermined sensed fluid pressures upstream from the flow control means, the first valve means opening in response to a first sensed pressure condition and thereby sequentially activating differential pressure responsive elements to operate the flow control means to open the fluid flow conduit and to permit the downstream movement of the first fluid therein, and means for closing the flow control means by sequentially reversing activation of the differential pressure responsive elements and closing the first valve means in response to a second pressure condition, closure of the first valve means automatically conditioning the pressure sensor means, without flow of a second fluid therethrough for a subsequent pressure responsive opening and closing cycle of the first valve means and the flow control means.

14. The apparatus of claim 13 wherein the pressure sensor means and the differential pressure responsive elements are incorporated into a single module adapted to be secured to flow control means and include continuous and intermittently operable condensate removal means and means for controlling the sequential activation interval of the differential pressure responsive elements.

* * * * *

UNITED STATES PATENT OFFICE

CERTIFICATE OF CORRECTION

Patent No. 4,373,838 Dated Feb. 15, 1983

Inventor(s) Brian E. Foreman; John M. Grooms

It is certified that error appears in the above-identified patent and that said Letters Patent are hereby corrected as shown below:

In column 7, line 24, change "flow" to --low--.

In column 7, line 59, change "38" to --138--.

Signed and Sealed this

Nineteenth Day of April 1983

[SEAL]

Attest:

GERALD J. MOSSINGHOFF

Attesting Officer

Commissioner of Patents and Trademarks